US009455068B2

(12) United States Patent
Omoto

(10) Patent No.: US 9,455,068 B2
(45) Date of Patent: Sep. 27, 2016

(54) BRAIDED CONDUCTOR

(71) Applicant: Sumitomo Wiring Systems, Ltd., Yokkaichi, Mie (JP)

(72) Inventor: Katsuhiro Omoto, Mie (JP)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 14/900,188

(22) PCT Filed: Jul. 1, 2014

(86) PCT No.: PCT/JP2014/067487
§ 371 (c)(1),
(2) Date: Dec. 21, 2015

(87) PCT Pub. No.: WO2015/005174
PCT Pub. Date: Jan. 15, 2015

(65) Prior Publication Data

US 2016/0155533 A1 Jun. 2, 2016

(30) Foreign Application Priority Data

Jul. 12, 2013 (JP) ..... 2013-146523

(51) Int. Cl.

| | |
|---|---|
| ***H01B 5/08*** | (2006.01) |
| ***H01B 7/29*** | (2006.01) |
| ***H01B 11/06*** | (2006.01) |
| ***H01B 7/08*** | (2006.01) |
| ***D04C 1/00*** | (2006.01) |
| ***H01B 5/12*** | (2006.01) |

(52) U.S. Cl.
CPC ..... *H01B 5/12* (2013.01)

(58) Field of Classification Search
CPC .... H01B 5/12; H01B 12/08; H01B 13/2606; D07B 2207/209
USPC ..... 174/117 M, 357, 393; 87/9, 11, 13
See application file for complete search history.

(56) References Cited

U.S. PATENT DOCUMENTS

| | | | | |
|---|---|---|---|---|
| 4,870,887 A * | 10/1989 | Tresslar | ..... | D04C 1/02 87/1 |
| 5,186,992 A * | 2/1993 | Kite, III | ..... | D04C 1/02 428/198 |
| 7,013,787 B2 * | 3/2006 | Shimizu | ..... | D04C 1/02 87/11 |

FOREIGN PATENT DOCUMENTS

| | | |
|---|---|---|
| JP | 2006-252937 | 9/2006 |
| JP | 2007-188782 | 7/2007 |

(Continued)

OTHER PUBLICATIONS

International Search Report.

*Primary Examiner* — Chau N Nguyen
*Assistant Examiner* — Roshn Varghese
(74) *Attorney, Agent, or Firm* — Gerald E. Hespos; Michael J. Porco; Matthew T. Hespos

(57) ABSTRACT

It is aimed to provide a technology for reducing the loosening of strands in a short-cut braided conductor. A short braided conductor 1 is obtained by cutting a long braided conductor 10 configured by braiding a plurality of strands 11 into a tubular shape to a desired cutting length (L1). The strands 11 are, for example, configured by conductors such as bare soft copper wires, oxygen-free soft copper wires or tin-plated soft copper wires. A spiral pitch (P1) of the strands 11 in this braided conductor 1 is preferably not less than twice and not more than five times of the cutting length (L1), more preferably not less than twice and not more than three times the cutting length (L1).

2 Claims, 2 Drawing Sheets

(56) References Cited

FOREIGN PATENT DOCUMENTS

| | | |
|---|---|---|
| JP | 2010-172162 | 8/2010 |
| JP | 2011-165428 | 8/2011 |
| JP | 2013-23776 | 2/2013 |

* cited by examiner

BRAIDED CONDUCTOR

BACKGROUND

1. Field of the Invention

The present invention relates to a braided conductor.

2. Description of the Related Art

Conventionally, a wiring harness with a braided conductor braided into a tubular shape is disclosed in Japanese Unexamined Patent Publication No. 2010-172162. Specifically, Japanese Unexamined Patent Publication No. 2010-172162 discloses a high-voltage wiring harness for electric vehicle in which wires are passed through a shield tube. The shield tube used here is formed by cutting a long braided conductor in the form of a mesh-like tube to a necessary length and applying a predetermined processing to end parts.

Further, in recent years, it has been proposed to use braided conductors at various positions, taking advantage of flexibility and the like of the braided conductors. For example, Japanese Unexamined Patent Publication No. 2011-165428 discloses a braided conductor (flexible conductor) for electrically connecting a terminal of a device-side connector and an electronic circuit of a device at a short distance from each other. By the deformation of this flexible conductor, the terminal is made movable within a predetermined clearance, thereby absorbing a dimensional tolerance that may be created between the terminal and a mating terminal.

As also described in Japanese Unexamined Patent Publication No. 2011-165428, a chance of using a relatively short braided conductor has been on the increase in recent years. However, there has been a problem that strands constituting a braided conductor are more easily loosened in braided conductors having a short cut length than in braided conductors having a long cut length. Thus, a technology for preventing the loosening of the cut braided conductor has been desired.

The present invention was developed in view of the above problem and aims to provide a technology for reducing the loosening of strands in a short-cut braided conductor.

SUMMARY

To solve the above problem, the disclosure is directed to a braided conductor obtained by cutting a long braided conductor configured by a plurality of strands braided into a tubular shape. A spiral pitch of the strands is not less than twice and not more than five times the length of the braided conductor.

According to a further aspect, the spiral pitch of the strands is not more than three times the length of the braided conductor in the braided conductor according to the first aspect.

Making the spiral pitch smaller reduces the loosening of the short braided conductor after cutting when the long braided conductor is cut.

DETAILED DESCRIPTION

Hereinafter, an embodiment of the present invention is described with reference to the accompanying drawings.

Note that the drawings may be shown in an exaggerated or simplified manner if necessary to facilitate understanding.

Figure 1:
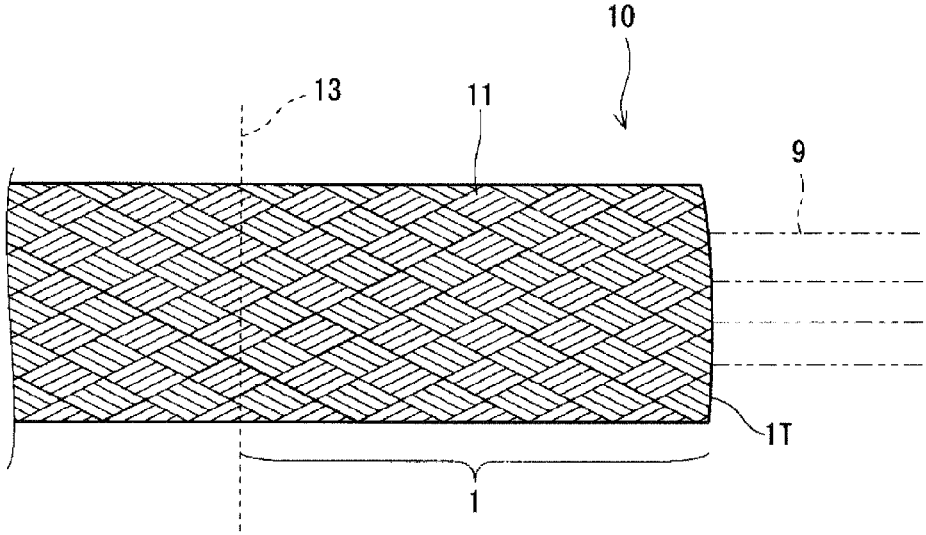
FIG. 1 is a side view showing a braided conductor according to the present invention.

FIG. 1 is a side view showing a long braided conductor 10. The long braided conductor 10 is formed by braiding a plurality of strands 11 into a hollow tube by a braiding machine. More specifically, the long braided conductor 10 is configured by braiding a plurality of sets (picks), each pick composed of a plurality of strands 11, like a plain weave, i.e. by interlacing warp and weft threads so that the warp and weft threads are alternately located up and down. The strands 11 constituting the long braided conductor 10 are, for example, configured by conductors such as bare soft copper wires, oxygen-free soft copper wires or tin-plated soft copper wires.

A short braided conductor 1 is obtained by cutting the long braided conductor 10 at a desired cutting position 13. One or more wires 9 are passed through a hollow interior of this braided conductor 1. Linear bodies other than the wires 9 may be passed through the hollow interior of the braided conductor 10. Further, the braided conductor 1 may be retrofitted on the wires 9 by passing the wires 9 through the hollow interior of the braided conductor 1, but the wires 9 may be passed through the hollow interior of the long braided conductor 10 from the beginning by braiding the strands 11 to cover the wires 9 in advance in the braiding machine. Further, although not shown, an attachment member or the like for attachment to a casing of an electrode device or the like may be, for example, attached to an end part 1T of the braided conductor 1. Further, it is not always necessary to pass the wires 9 or the like through the hollow interior of the braided conductor 1 and the braided conductor 1 is conceivably used as a conductive wire.

Figure 2:
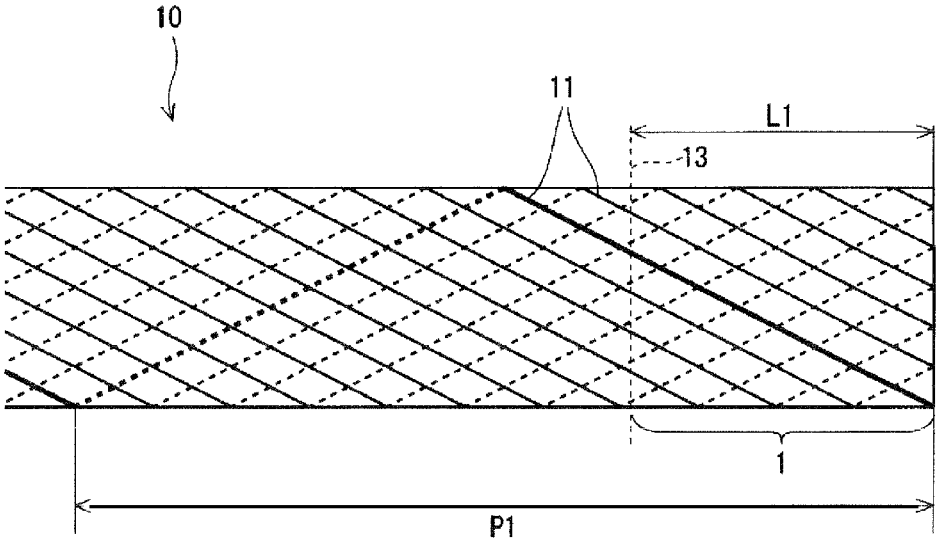
FIG. 2 is a side view conceptually showing a spiral structure of strands constituting the braided conductor.

FIG. 2 is a side view conceptually showing a spiral structure of the strands 11 constituting the long braided conductor 10. In FIG. 2, only some of the strands 11 extending in the same spiral direction are shown for convenience of description and a part of each strand 11 passing on a front side is shown by solid line and a part thereof passing on a rear side is shown by broken line.

As shown in FIG. 2, in the long braided conductor 10, each strand 11 is spirally arranged at a spiral pitch (P1, i.e. a moving distance of each strand 11 along an axial direction during one rotation) having a specified length.

In the long braided conductor 10, the respective strands 11 support the strands in another set to prevent loosening by being braided with each other. However, when the long braided conductor 10 is cut at the position of a cutting line 13 shown in FIG. 2, a force acts on the respective strands 11 in a direction such as to pull out the strands 11, whereby the strands 11 may be loosened. Particularly, if a cutting length (L1) is shorter than the spiral pitch (P1), the strands 11 are easily loosened.

Accordingly, whether or not the strands 11 were loosened when the long braided conductor 10 was cut was verified while the spiral pitch was changed. In the following test, the long braided conductor 10 whose number of spindles (number of picks) was 44, whose number of ends (number of the strands 11 in one pitch) was 30 and which had a strand diameter of 0.12 mm was used as an example.

Figure 3:
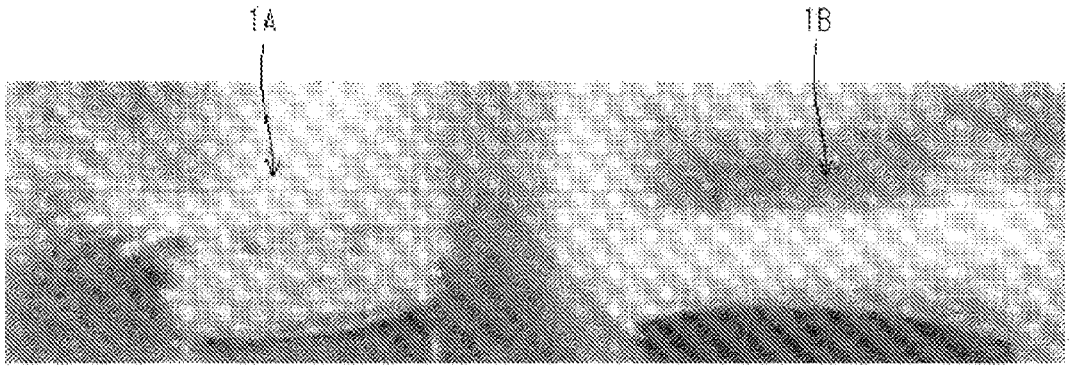
FIG. 3 is a side view showing two braided conductors having different spiral pitches.

FIG. 3 is a view showing two braided conductors 1A, 1B having different spiral pitches. The braided conductor 1A is obtained by cutting a long braided conductor 10 having a spiral pitch of 225 mm to a cutting length of 45 mm (test 1). Further, the braided conductor 1B is obtained by cutting a long braided conductor 10 having a spiral pitch of 125 mm to a cutting length of 45 mm (test 2).

In the case of the braided conductor 1A according to the test 1, i.e. when the spiral pitch is five times the cutting length, the strands 11 are loosened by cutting and it is difficult to maintain shape (left side in FIG. 3). On the other hand, in the case of the braided conductor 1B according to the test 2, i.e. when the spiral pitch is slightly less than three times the cutting length (specifically, 2.67-fold), the strands 11 are not loosened by cutting and the shape of the braided conductor 1B is maintained (right side in FIG. 3).

Specifically, it is apparent from the result of the tests 1, 2 that the spiral pitch is desirably less than five times the cutting length, more preferably not more than three times the cutting length. As just described, if the cutting length is the same, braided stitches become finer as the spiral pitch becomes smaller. This causes the respective strands 11 to be more firmly supported on the other strands 11. That is, by reducing the spiral pitch, the loosening of the strands 11 can be suppressed.

However, if the spiral pitch is excessively small (e.g. if the spiral pitch is less than twice the cutting length), a chance of the strands 11 abrading against each other increases, whereby the strands 11 may be damaged. Thus, the spiral pitch is desirably more than twice the cutting length.

To sum up, the spiral pitch is preferably not less than twice and not more than five times the cutting length, more preferably not less than twice and not more than three times the cutting length to prevent the loosening of the strands 11 by cutting.

Although this invention has been described in detail, the above description is illustrative in all aspects and does not limit this invention. It is understood that numerous unillustrated modifications can be devised without departing from the scope of this invention.

LIST OF REFERENCE SIGNS

1, 1A, 1B braided conductor
10 long braided conductor
11 strand
13 cutting position
9 wire

The invention claimed is:

1. A braided conductor obtained by cutting a long braided conductor configured by a plurality of strands braided into a tubular shape, wherein a spiral pitch of the strands is not less than twice and not more than five times the length of the braided conductor.

2. The braided conductor of claim 1, wherein the spiral pitch of the strands is not more than three times the length of the braided conductor.

* * * * *